United States Patent [19]

Salminen

[11] Patent Number: 4,622,911

[45] Date of Patent: Nov. 18, 1986

[54] PLUMBING INSTALLATION

[75] Inventor: Arthur H. Salminen, Waynesboro, Va.

[73] Assignee: Hopeman Brothers, Inc., Waynesboro, Va.

[21] Appl. No.: 643,364

[22] Filed: Aug. 23, 1984

Related U.S. Application Data

[62] Division of Ser. No. 478,388, Mar. 24, 1983, Pat. No. 4,477,934.

[51] Int. Cl.[4] ..... A47K 4/00

[52] U.S. Cl. ..... 114/71; 4/663; 4/596; 4/612; 4/613

[58] Field of Search ..... 114/71, 83, 85; 4/596, 4/597, 599, 600, 602, 603, 612–616, 618, 661, 663, 191

[56] References Cited

U.S. PATENT DOCUMENTS

| | | | |
|---|---|---|---|
| 1,410,607 | 3/1922 | Schmidt | 4/597 |
| 2,331,592 | 10/1943 | Bagwell | 4/663 |
| 2,438,665 | 3/1948 | Hesse | 4/663 |
| 3,005,205 | 10/1961 | Breen | 4/664 |
| 3,501,879 | 3/1970 | Mitchell | 4/612 |
| 3,651,776 | 3/1972 | Hopeman | 114/71 |
| 3,668,710 | 6/1972 | Dowd | 4/597 |
| 3,766,574 | 10/1973 | Smid | 4/663 |
| 4,215,444 | 8/1980 | Brown | 4/612 |
| 4,348,777 | 9/1982 | Peterson | 4/596 |
| 4,477,934 | 10/1984 | Salminen | 4/663 |

OTHER PUBLICATIONS

Pages 50–59 of publication entitled "Crew Accommodations", Marine Engineering/Log, dated Jun. 1982.

13 sheets of drawings of Tacoma Boatbuilding Co., of Tacoma, Washington, dated 1980–1981.

*Primary Examiner*—Trygve M. Blix

*Assistant Examiner*—C. T. Bartz

*Attorney, Agent, or Firm*—Howson and Howson

[57] ABSTRACT

A shipboard bathroom module comprises a prefabricated base pan in which a floor drain and a shower drain are located adjacent to each other but on opposite sides of a shower stall curb. Both drains communicate with a common receptacle molded into the base. Water from a wash basin at a remote location within the module is conducted to the receptacle through the shower stall curb, which is hollow. A trap, which serves both drains as well as the wash basin, is located in a box which provides a recess in the deck. In one version of the invention the receptacle built into the bathroom base sits on top of the trap, and the trap is accessible through one of the drain openings in the floor of the module. In another version, wastewater is conducted out of the receptacle through a laterally extending conduit to a trap which serves two adjacent bathroom modules. In either case, the box in which the trap is located is prefabricated with various water supply and drain pipes already welded to its floor. The box itself serves as a deck beam reinforcing header when it is necessary to cut through one or more deck beams for pipe tree installation. This structure eliminates a great deal of labor in the installation of a shipboard bathroom and provides a bathroom in which the floor is only a very short distance above the deck level.

6 Claims, 12 Drawing Figures

PLUMBING INSTALLATION

CROSS-REFERENCE TO RELATED APPLICATION

This is a division of my copending application, Ser. No. 478,388, filed Mar. 24, 1983, now U.S. Pat. No. 4,477,934 dated 10/23/84.

BRIEF SUMMARY OF THE INVENTION

This invention relates to bathrooms, and more specifically to a modular bathroom installation suitable for installation aboard ship.

In many modern merchant ships and naval vessels, accommodations are designed so that crew members as well as officers have their own individual staterooms and bathroom facilities. The trend toward individual bathroom facilities have given rise to a number of problems.

One problem arises because each bathroom ordinarily has three drains: a wash basin drain, a shower drain, and a floor drain. All of these drains are at separate locations on the bathroom floor. Therefore, at least three separate holes have to be cut in the deck for each of the many bathrooms aboard ship just to accommodate the drains. Plumbing must be installed underneath the deck to connect the drain openings to a common drain pipe. If the bathroom has a one-piece floor, it is also necessary to align the holes cut in the deck with the drain openings in the bathroom floor. If the bathroom has a ceramic tile floor, the tiles must be secured in place individually in such a way as to provide drain openings at the proper locations. In either case, a great deal of labor is required. In general, installation of a conventional shipboard bathroom has been very dirty, laborious and time-consuming.

Another problem in the installation of a shipboard bathroom arises because each of the three drains for the bathroom uses a separate trap, and the shower and floor drain traps are installed directly underneath their respective drains, below the deck. Not only is it difficult to install these traps but, after installation, the traps are very difficult to reach for cleaning or repair.

Another problem with conventional shipboard bathroom installations is that individual holes are cut in the deck for vertically extending water supply and drain pipes. These pipes are individually welded in the deck holes. The required cutting and welding operations are both time-consuming and expensive. Further problems arise because the vertically extending supply and drain pipes must be positioned to clear deck beams which extend underneath the metal deck for support. If the positions of bathrooms on a deck happen to be such that it is not practical to arrange the piping to clear a deck beam, the deck beam must be cut away and reinforced by a header which extends around the installed pipes and is welded to both parts of the cut-away deck beam.

It is an object of the invention to provide a shipboard bathroom which is structurally much simpler and easier to install than present shipboard bathrooms. It is also an object of the invention to overcome one or more of the above-mentioned problems, and specifically to eliminate the need for cutting separate holes in a deck for individual bathroom drain connections and for individual vertically extending water supply and drain pipes; to eliminate the labor required to install a tile floor in the bathroom by using instead a one-piece floor or a floor consisting of a relatively small number of pieces; to overcome the problem of aligning multiple drain holes in a one-piece bathroom floor with holes cut in the deck; and to reduce the amount of labor required when it becomes necessary to cut through a deck beam in order to install water supply and drain pipes. Still another object of the invention is to provide a bathroom installation in which all three drains, i.e. the shower drain, the wash basin drain and the floor drain are all served by a single trap which is readily accessible, and which is operative at steep pitching and rolling angles.

In accordance with the invention, a modular bathroom is provided which comprises walls extending upwardly from a prefabricated base. The base is in the form of a pan, and includes a floor as well as a receptacle positioned underneath the floor and arranged to receive water flowing downwardly through the wash basin drain, the floor drain and the shower drain. The receptacle conducts water from all three drains to a common trap. The trap may also serve one or more adjacent bathrooms. The main advantage of the specially constructed prefabricated base is that the receptacle, which is permanently embedded in the bathroom floor structure, has a very small maximum vertical dimension, i.e., about two inches. Therefore, the bathroom floor can be very close to the deck surface, yet it is not necessary to cut multiple holes in the deck below the drain openings of the bathroom floor for connections between the drains and a common vertically extending drain pipe.

With the foregoing structure, the outlet of the receptacle under the bathroom floor is necessarily very close to the deck. The close proximity of the receptacle outlet to the deck would seem to necessitate a trap at an inconvenient or inaccessible location just below the deck. However, in accordance with the invention, provision is made for connection of the receptacle to a common trap which is accessible from above the deck rather than from below it. The trap is located within a rigid pipe tree box which has a bottom plate and vertically extending walls. The box is situated in a opening cut in the deck adjacent to the modular bathroom, and the vertically extending side walls of the box are welded to the deck along a line such that the bottom plate of the box is situated below the deck. Supply and drain pipes extend through the bottom plate of the box, and are rigidly secured to the bottom plate. These supply and drain pipes include not only hot and cold fresh water supply pipes, and a drain pipe for the fresh water, but also a salt water supply pipe and a drain pipe for a toilet. The pipes extending through a given plate can serve one bathroom module or several adjacent bathroom modules, typically two. Since the rigid box provides a recess in the deck, a trap can be provided within the box at a position to receive water from the receptacle underneath the bathroom floor. The recessed box allows the trap to have a sufficiently large vertical dimension to enable it to remain operative even under severe rolling conditions. At the same time the recessed box makes the trap accessible from above the deck.

The rigid box has another advantage in that it can be provided in prefabricated form with supply and drain pipe sections already connected to it and extending through its bottom plate. It has the further advantage that its vertical sides can be welded not only to the deck, but also to the parts of a cut-away deck beam so that it serves as a header when it becomes necessary to cut through a deck beam in order to install the piping at the desired position.

Further details and further objects and advantages of the invention will become apparent from the following detailed description when read in conjunction with the drawings.

DETAILED DESCRIPTION

The modular bathroom in accordance with the invention is prefabricated in the sense that much of the assembly of the bathroom enclosure and its associated pipe tree takes place in the factory, and the assembled parts are carried aboard ship for final assembly and installation with a minimum of labor. The bathroom module described herein consists of several prefabricated parts which are assembled aboard ship. The bathroom module includes a prefabricated base, several wall elements which attach to the base, a shower dome, which is a unit providing the walls and ceiling of the shower, and a ceiling panel which serves as the ceiling of the toilet and lavatory space of the module. So far as this invention is concerned, the prefabricated base is the most important element, because it includes all of the structure which connects the lavatory, the shower drain, and the floor drain to a common trap. The base is generally in the form of a large pan, having a floor with curbs along its periphery as well as an internal curb separating the floor of the shower stall from the floor of the toilet and lavatory space.

Figure 1:
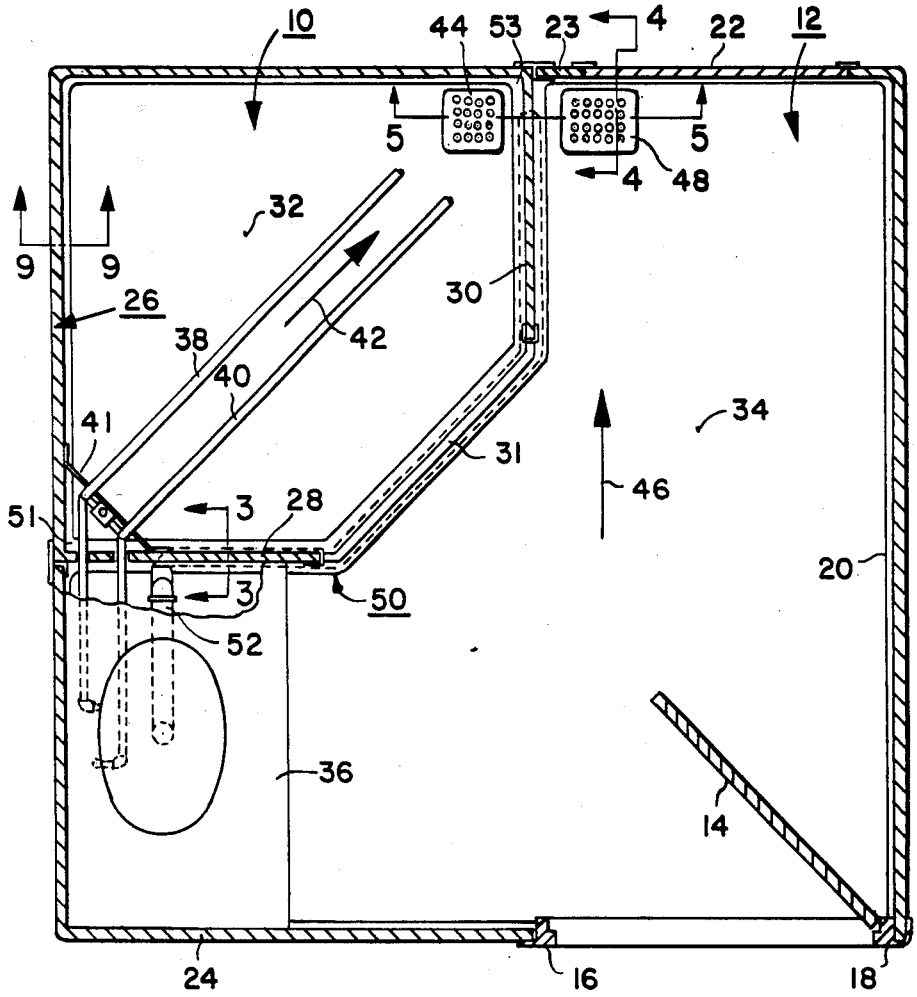
FIG. 1 is a horizontal section of a modular bathroom in accordance with the invention, as viewed from above.

Referring to FIG. 1, the modular bathroom consists of a shower stall 10 and a toilet and lavatory space 12. The toilet and lavatory space is entered through an access door 14 hinged in a door frame comprising vertical frame elements 16 and 18.

The walls of the toilet and lavatory space are provided by wall elements 20, 22, 23 and 24. Element 22 is a removable panel allowing access to the pipe tree from the interior of the toilet and lavatory space, the pipe tree being located outside the module adjacent to this panel.

The walls of the shower stall are constituted by a unitary shower dome 26 which includes not only the exterior walls of the shower stall, but also interior walls 28 and 30. Entrance to the shower stall from the toilet and lavatory space is over a coaming 31 and between the ends of wall elements 28 and 30.

The floor of the shower stall is indicated at 32, and the floor of the toilet and lavatory space is indicated at 34. A lavatory or wash basin is provided at 36, and hot and cold water supply pipes 38 and 40 extend from the pipe tree, over the top of the shower dome, and then down behind pipe-concealing panel 41 and through wall element 28 at a level between floor 34 and lavatory 36.

Floor 10 of the shower stall slopes downwardly in the direction of fall line 42 toward perforated cover plate 44 of the shower drain. Similarly, floor 12 of the toilet and lavatory space slopes downwardly in the direction of fall line 46 toward cover 48 of the floor drain, i.e. the drain for the toilet and lavatory space. The slopes of floors 10 and 12 are such that flow converges toward the locations of the drains which are adjacent to each other but on opposite sides of shower stall wall element 30.

When the bathroom is completely installed, a toilet (not shown) is located within the toilet and lavatory space adjacent to drain plate 48.

Coaming 31 of the shower stall entrance is part of a curb 50 which extends from corner 51 of the shower stall to corner 53. The curb is hollow, and the lavatory drain pipe 52 is connected through an elbow to a pipe shown in broken lines, which extends through the hollow space of curb 50 to a location between drain plates 44 and 48. This pipe, as well as the floor and shower drains communicate with a common receptacle built into the floor of the module. The common receptacle is connected to a single trap, as will be apparent from the description which follows with particular reference to FIGS. 4, 5, 6 and 7.

The structural elements of the bathroom module consist of glass fiber-reinforced polyester resin, with the exception of floors 32 and 34, which are panels having aluminum honeycomb cores with faces of reinforced polyester resin. Various alternative materials can be used for the floors, including faced structures with cores of paper honeycomb, balsa or foam, or various fiber-reinforced resin sheets.

Figure 3:
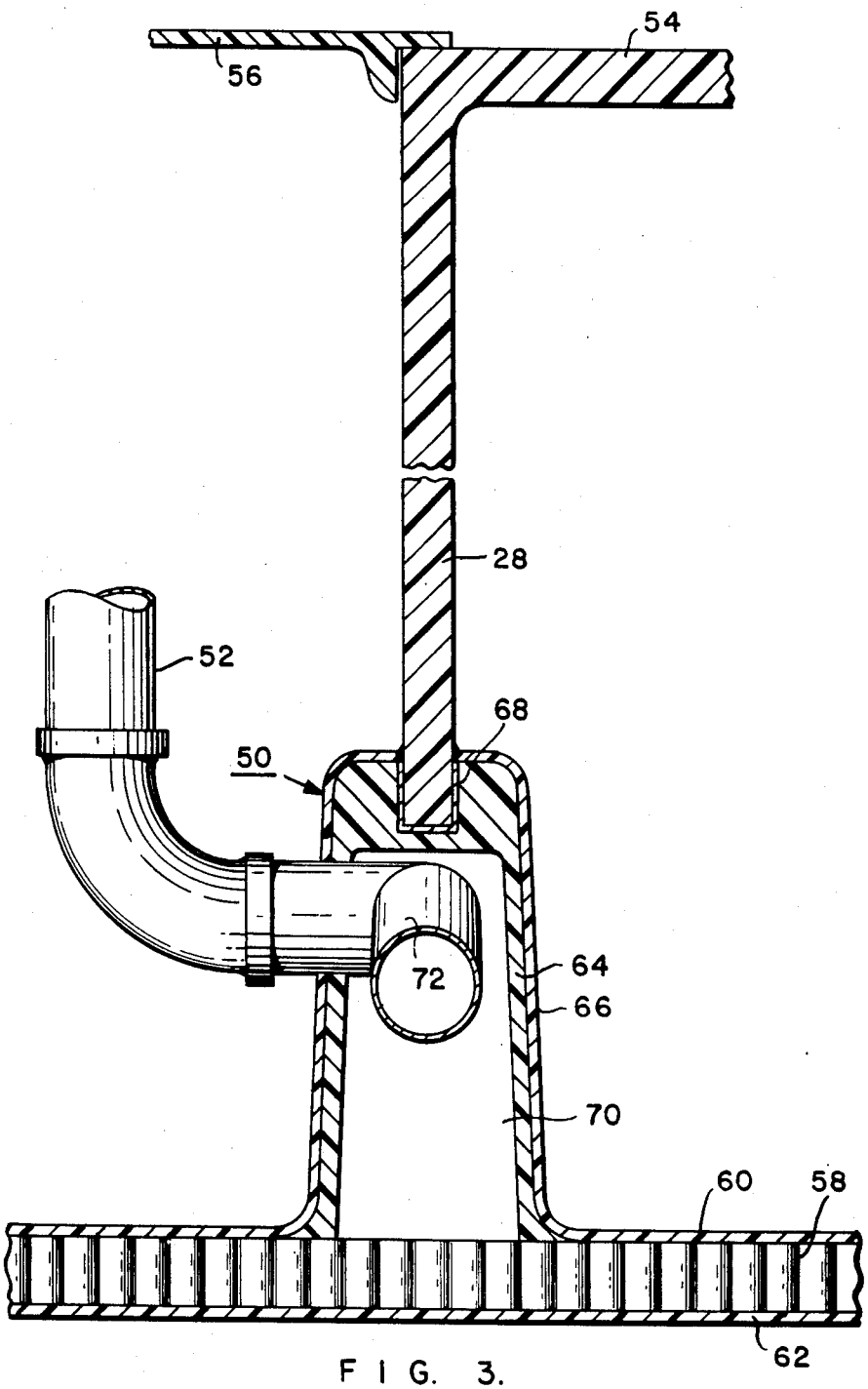
FIG. 3 is a vertical section taken on the plane 3—3 of FIG. 1.

FIG. 3 shows the top 54 of the shower dome, which also includes wall element 28 located between the lavatory and the shower stall. This figure also shows ceiling panel 56 of the toilet and lavatory space engaged with the shower dome at the upper edge of wall element 28.

Wall element 28 extends upwardly from hollow curb 50.

The floor comprises a fire retardant paper honeycomb structure 58 with upper and lower layers 60 and 62 of glass fiber-reinforced polyester adhesively secured to the honeycomb core by polyester resin containing a filler which gives the resin a consistency allowing it to bond to the walls of the honeycomb cells.

Curb 50 comprises a hollow, glass-reinforced polyester structure 64, the skin 66 of which is continuous with layer 60 of the floor. The skin is interrupted only by wall element 28 of the shower dome, which fits into a channel 68 embedded in the top of curb structure 64.

Shower dome wall element 28 is caulked at the location where it meets the top of curb 50.

Hollow space 70 within the curb is of sufficient height to permit drain pipe 72 to have a continuous downward pitch from the point where it enters the curb as shown in FIG. 3 to its opposite end adjacent to corner 53 (FIG. 1). Pipe 72 is preferably a soft copper tube although PVC pipe may be used as an alternative. It connects to lavatory drain pipe 52 through an elbow, as shown in FIG. 3. Pipe 72 is part of the factory-assembled prefabricated base structure, which also includes the floor, the shower curb, the curbs at the bottoms of the exterior walls of the module, and a drain receptacle. The drain receptacle is shown in FIG. 4.

Figure 4:
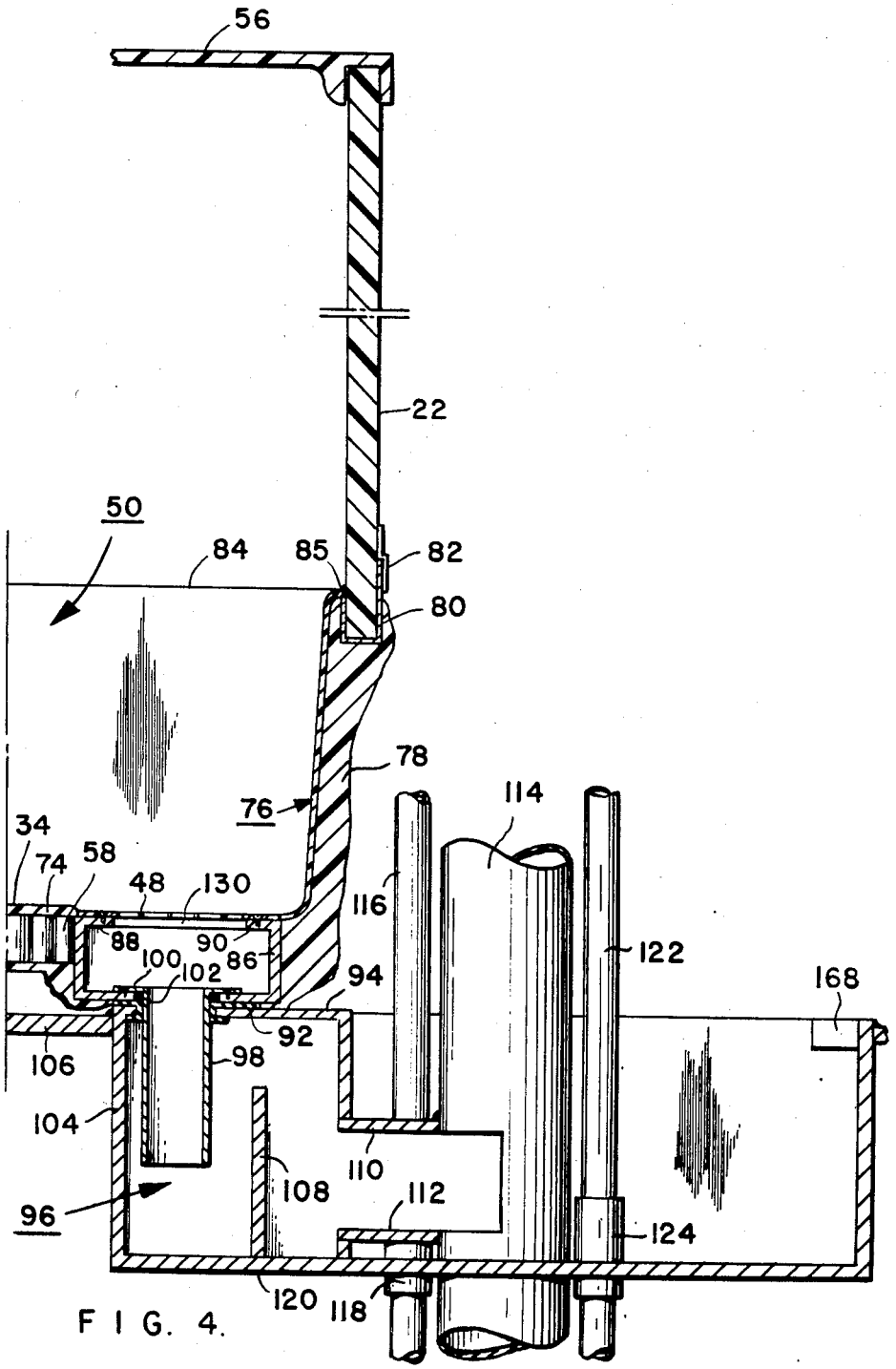
FIG. 4 is a vertical section taken on the surface 4—4 of FIGS. 1 and 7.

FIG. 4 shows removable wall panel 22 at the top of exterior curb 76 which consists of glass fiber-reinforced polyester at 78. This curb need not be finished on the outside of the module, but preferably has a finished layer facing the inside of the module. This finished layer is continuous with upper layer 74 on the floor honeycomb core 58 except for interruptions by the drain openings.

Panel 22 fits into a metal channel 80 embedded in the upper edge of curb 76. A spring clip 82 secured to the outer face of panel 22 engages a part of channel 80 which extends upwardly from curb 76. Curb 76 is continuous with curb 50 of the shower stall, and caulking is provided along upper edge 84 of curb 50 as well as along upper edge 85 of curb 76.

Receptacle 86 is a stainless steel trough embedded in glass-reinforced polyester in the floor of the module adjacent to curb 76. The receptacle extends from underneath shower drain cover plate 44 to a location underneath floor drain cover plate 48 (FIG. 1). As shown in FIG. 4, floor drain cover plate 48 is secured by screws to inwardly projecting flanges 88 and 90 of receptacle 86. The receptacle rests on a gasket which fits into a rectangular opening in upper wall 94 of a trap 96. A rectangular trap boot 98 extends downwardly through this opening, and its upper flange 100 is removably secured to the bottom wall of the receptacle by screws. Caulking is provided at 102 just underneath the flange.

Trap 96 is part of a rectangular, open-topped metal pipe tree box 104, which is welded into a rectangular opening in metal deck 106. Box 104 provides a recess for the trap structure, and also holds sections of water supply and drain pipes which are secured to its bottom wall.

The trap comprises a baffle 108 which extends upwardly from bottom wall 120 of box 104 to a location above the lower end of trap boot 98. Horizontal plates 110 and 112 are the upper and lower boundaries of a rectangular passage which forms the trap outlet and which connects to sanitary drain pipe 114. The design of the trap is such that the vertical distance between the bottom of trap boot 98 and the top of baffle 108 can be as great as necessary to accommodate pitching and rolling movement of the ship. Operativeness of the trap is insured under all conditions, without affecting the height of the bathroom floor above the deck and without making it necessary to gain access to the trap from underneath the deck.

A cold water supply pipe 116 is secured in a sleeve 118 which is, in turn, secured to bottom wall 120 of box 104. Similarly, hot water supply pipe 122 is secured in a sleeve 124 which is secured to bottom wall 120 of the box. Drain pipe 114 is also secured to the bottom wall of the box along with various other supply and drain pipes, including a salt water supply pipe for flushing purposes and a large soil drain pipe (not shown) in FIG. 4, but shown in FIGS. 5, 6 and 7).

Figure 5:
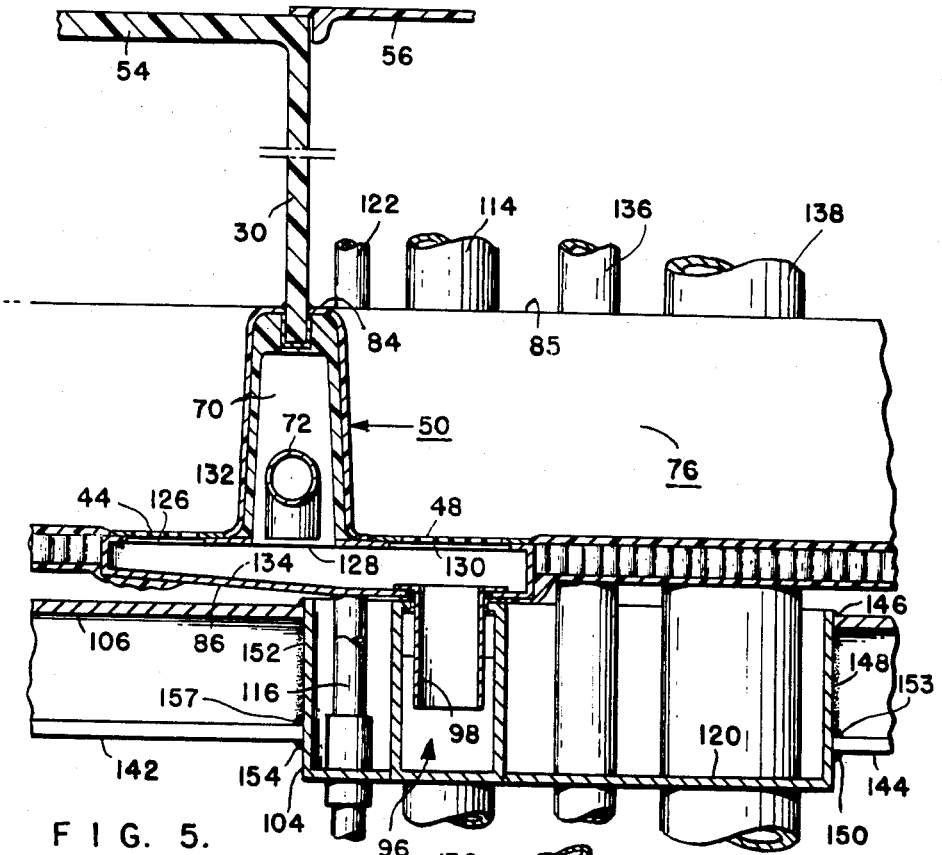
FIG. 5 is a vertical section taken on the plane 5—5 of FIGS. 1 and 7 but with the wall panels of the module removed.

In FIG. 5, the exterior walls are removed for clarity. However, curbs 50 and 76 are shown. As shown in FIG. 5, receptacle 86 has three openings for receiving water. A first opening 126 serves as the drain for the shower, and is covered by removable plate 44. The second opening 128 is located directly underneath curb 50, and receives water from the lavatory drain. The third opening 130 serves as the floor drain, and is covered by removable plate 48. Trap boot 98 is accessible through opening 130.

Receptacle 86 receives water from the lavatory through downwardly projecting end 132 of sloping pipe 72 within hollow space 70 of curb 50. Receptacle 86 has a sloping floor at 134 to cause water from shower drain opening 126 and from lavatory drain pipe 72 to flow toward trap 96.

Pipe 136 is the salt water flushing supply pipe, and pipe 138 is the soil drain pipe. Both of these pipes, along with pipes 116, 122 and 114 are rigidly secured to plate 120 of box 104.

Figure 6:
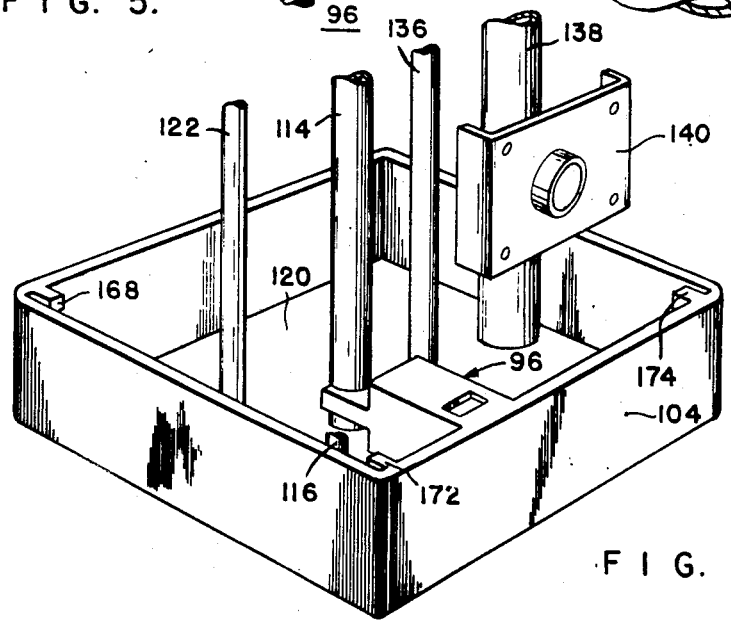
FIG. 6 is an oblique perspective view of the pipe tree box, with pipes partially broken away.

The relationship between box 104, the trap and the various supply and drain pipes will be apparent from FIG. 6. While the particular box shown has only one trap and serves only a single bathroom module, it is possible to provide an additional trap so that the box can serve two adjacent bathroom modules. As shown in FIG. 6, soil drain pipe is provided with a toilet support plate 140. In the case of a pipe tree box designed to serve two adjacent bathroom modules, pipe 138 would have two back-to-back toilet support plates corresponding to plate 140.

Figure 7:
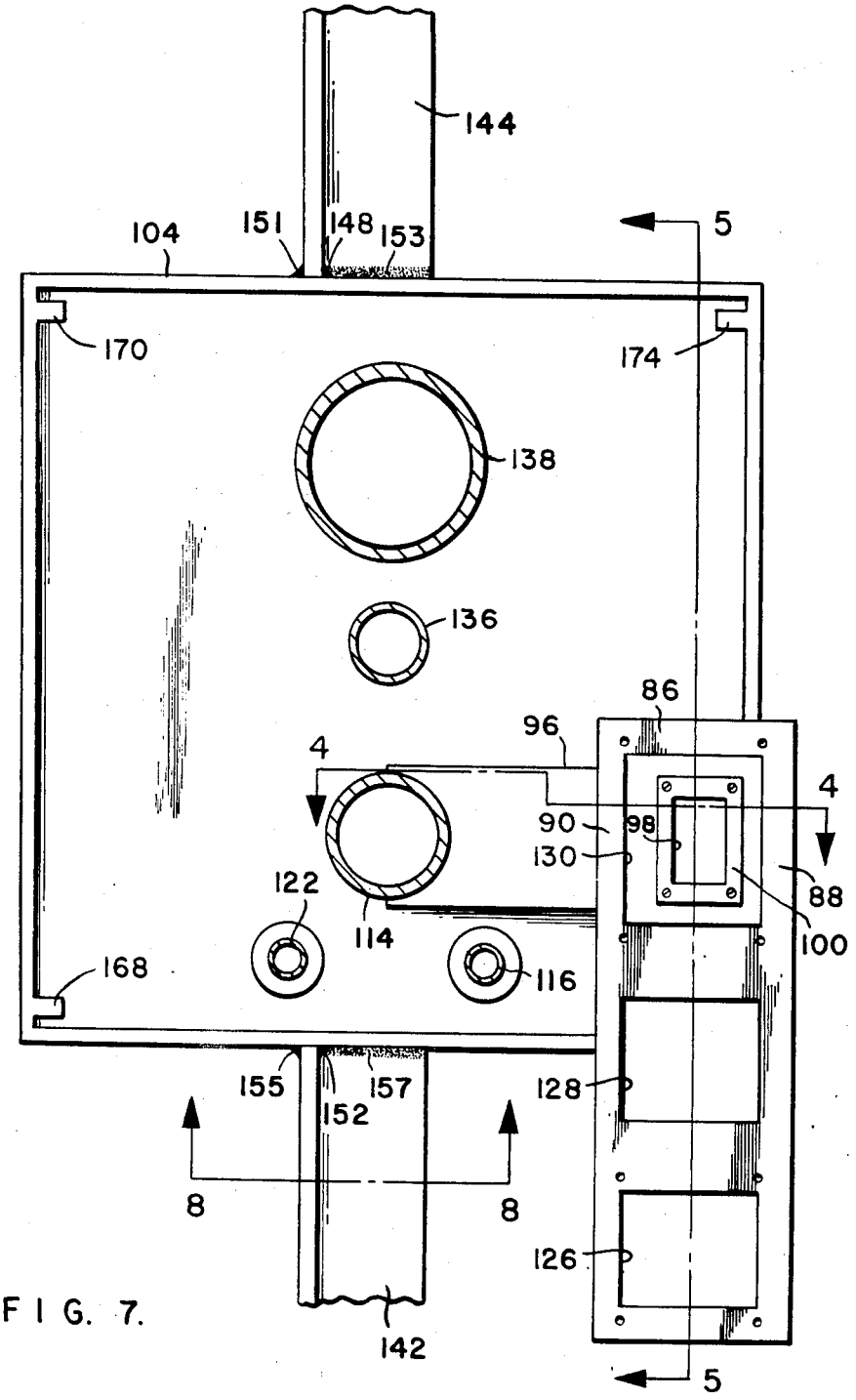
FIG. 7 is a top plan view showing the pipe tree box and illustrating its relationship to the receptacle underneath the bathroom module.

Box 104 serves another important function, which is to eliminate the need for cutting multiple holes in the deck to accommodate various supply and drain pipes and to eliminate the labor involved in installing headers for reinforcement of deck beams when it becomes necessary to cut through a deck beam. Referring to FIGS. 5 and 7, a deck beam is shown consisting of parts 142 and 144, the portion connecting these parts having been removed in the course of cutting a hole in the deck to accommodate pipe tree box 104. The box itself is welded to the deck at 146, and to the deck beam along welds 148, 150, 152 and 154 shown in FIG. 5, as well as along welds 151, 153, 155 and 157, shown in FIG. 7.

FIG. 7 also further illustrates the relationship between box 104 and receptacle 86, the receptacle being shown by itself without the floor structure in which it is embedded.

Figure 8:
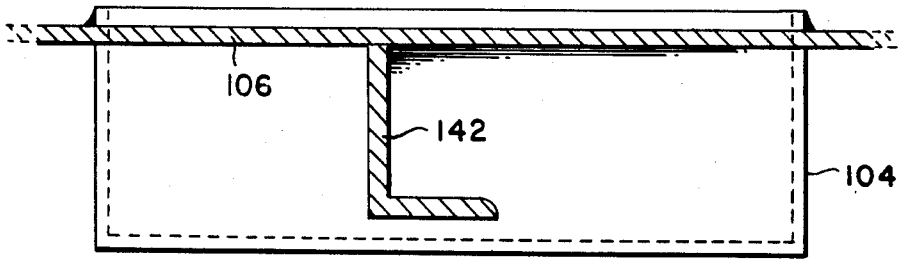
FIG. 8 is a vertical section taken on the plane 8—8 of FIG. 7, showing how the pipe box serves as a header for a cut-away deck beam.

FIG. 8 further illustrates the relationship between pipe tree box 104, deck 106 and deck beam part 142.

Figure 9:
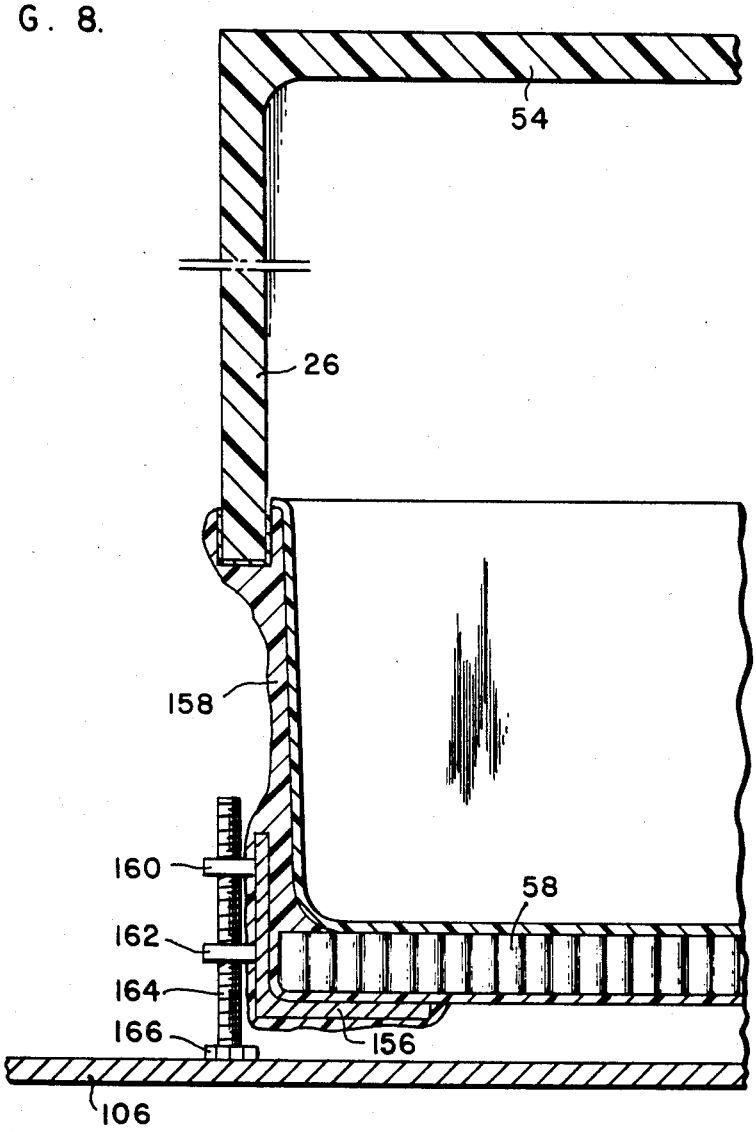
FIG. 9 is a vertical section taken on the plane 9—9 of FIG. 1.

FIG. 9 shows the levelling structure of the module base at the corner of the shower stall. Similar levelling structures are provided at the corner adjacent to the lavatory, at the corner adjacent to the access door hinge, and at the corner adjacent to the toilet. Embedded in the glass-reinforced polyester of the shower curb 158 is an angle 156 having outward horizontal projections 160 and 162 into which is threaded a bolt 164, having a head 166 which rests on deck 106. The module is levelled by adjustment of head 166 and the corresponding bolt heads of the other levelling devices using wrenches. The bolt heads are eventually welded to the deck to secure the bathroom module against movement.

Figure 2:
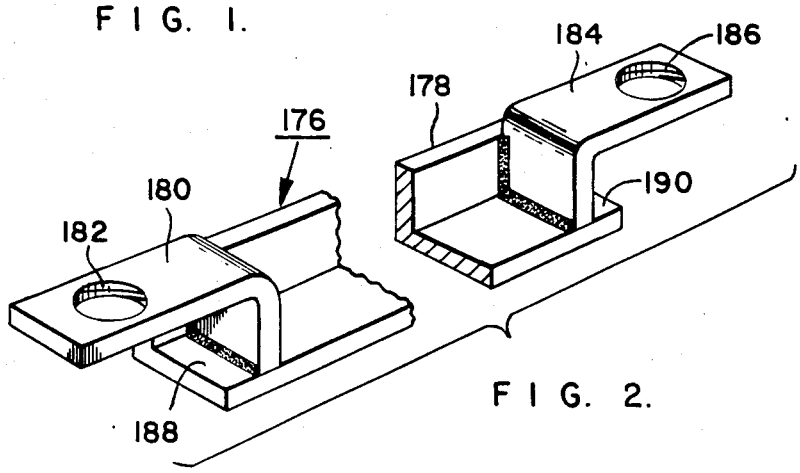
FIG. 2 is a fragmentary perspective view of a levelling tool for the pipe box.

Returning to FIG. 6, box 104 has, near its four corners along its upper edge, four inwardly extending projections 168, 172, 174 and 170. (Projection 170 is seen in FIG. 7 but not in FIG. 6.) These projections cooperate with the special tool shown in FIG. 2 for levelling the pipe tree assembly before its box 104 is welded to the deck, and for supporting the box during initial welding. The tool 176 (FIG. 2) comprises an elongated angle 178, the length of which is just slightly less than the distance between the walls of the box from which projections 168–174 extend. L-shaped member 180 is welded to angle 178 a short distance from one end, leaving a ledge 188. Member 180 overhangs the end of angle 178, and has a threaded hole 182 which is located beyond the end of angle 178. A similar L-shaped member 184 is welded at the other end of angle 178, leaving a ledge 190. Member 184 has a threaded hole 186 which is located beyond the end of angle 178.

In installing the pipe tree assembly, two tools corresponding to tool 176 are used simultaneously. One tool is engaged with its ledges corresponding to ledges 188 and 190 located respectively underneath projections 168 and 172 of the pipe tree box (FIG. 6). The other tool is similarly engaged with projections 170 and 174 of the pipe tree box (see FIG. 7). Bolts are threaded downwardly through the holes corresponding to holes 182 and 186. These bolts engage the deck, and allow for fine levelling adjustment of the pipe tree assembly before welding. After the box is at least partially welded to the deck at weld 146 (FIG. 5), the tools are removed, and welding is completed.

From the foregoing description of the structure of the modular bathroom installation, it will be apparent that a great deal of labor is saved in shipboard bathroom installations by virtue of the fact that the shower stall, the floor, and the lavatory use a common drain trap, and by virtue of the fact that most of the structure for conducting water to the common trap is built into the prefabricated bathroom base. The fact that the trap is located in a pipe tree box and recessed below deck level makes it possible to provide a shipboard bathroom in which the floor is only a very short distance above deck level while the trap is accessible from above the deck. Also contributing to the closeness of the module's floor level to the deck level is the arrangement of the shower and floor drains adjacent to each other and in cooperation with a receptacle which has a very small vertical dimension, and the use of the hollow shower stall curb to conduct wastewater from the lavatory to the common drain receptacle.

The foregoing arrangement makes it possible to provide a module in which the elevation of the floor is only about $3\frac{1}{4}$ inches above the deck at its maximum height (i.e. at the location of the access door) and only about $2\frac{1}{4}$ inches above the deck at the location of the floor drain cover plate 48.

Various modifications can be made in the specific structure described. For example, a pipe tree box serving only one bathroom module can be smaller than the box shown, since the part of the box located to the right of sleeve 124 in FIG. 4 serves no purpose and its size can be reduced.

Figure 11:
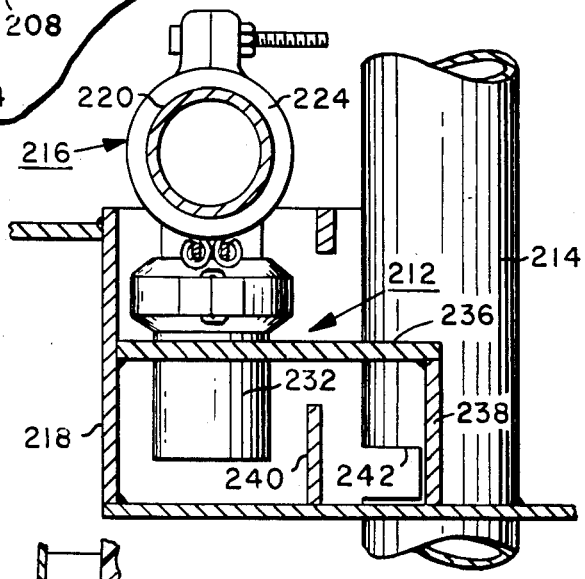
FIG. 11 is a vertical section taken on plane 11—11 of FIG. 10.
Figure 12:
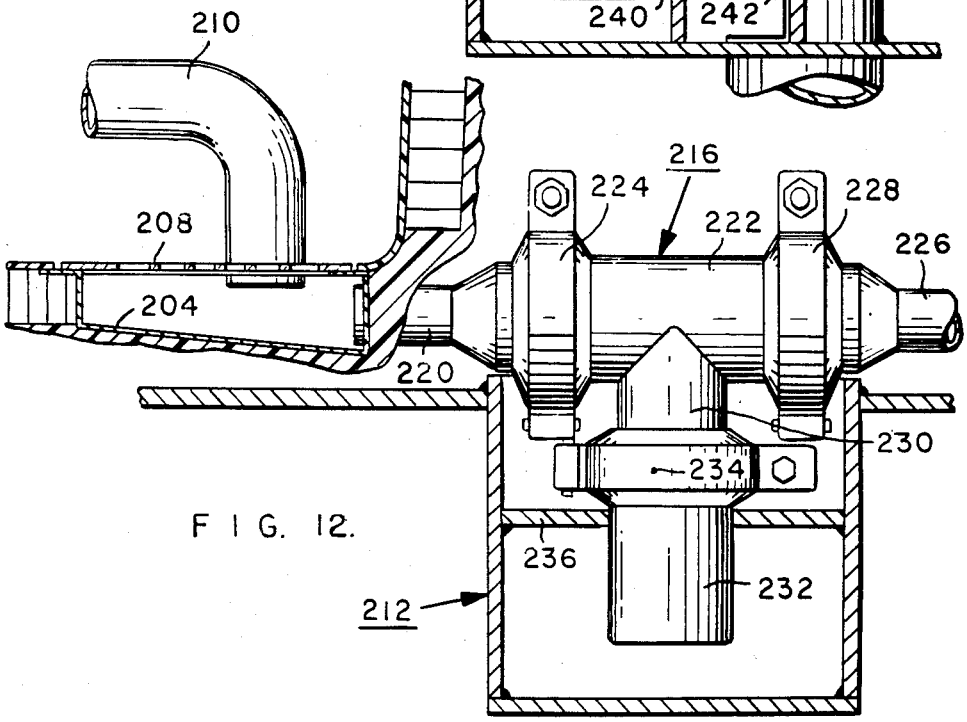
FIG. 12 is a vertical section taken on surface 12—12 of FIG. 10.

While the trap may be positioned directly underneath the floor drain opening as shown in FIG. 4, it is possible as an alternative to provide a horizontal exit passage from the common wastewater receptacle leading to a trap laterally spaced from the receptacle. With this arrangement, a trap can serve more than one bathroom module. Such an arrangement is illustrated in FIGS. 10, 11 and 12.

Figure 10:
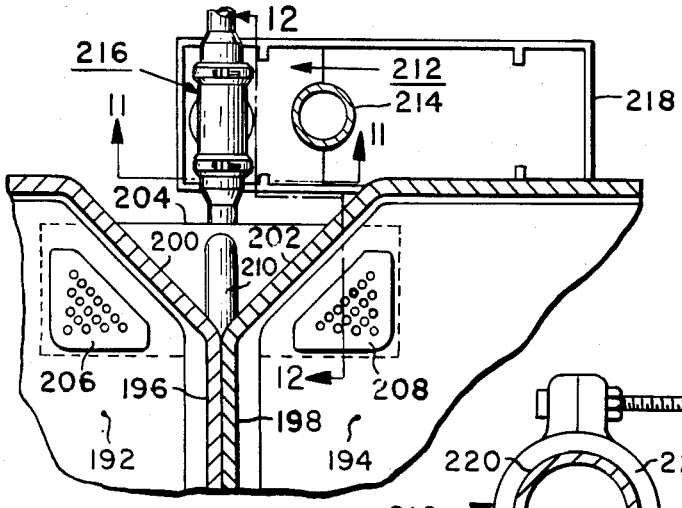
FIG. 10 is a fragmentary horizontal section, as viewed from above, through a bathroom module, illustrating an alternative receptacle and trap configuration.

FIG. 10 shows floor 192 of a shower stall and floor 194 of a toilet and lavatory space. In this particular module, the shower stall on the one hand and the toilet and lavatory space on the other are provided respectively with their own walls 196 and 198, which come together as shown in FIG. 10 to form a partition separating the two spaces.

Walls 196 and 198 are chamfered respectively at 200 and 202 to provide a triangular access space for installation and maintenance of the plumbing between two adjacent bathroom modules located on opposite sides of a common pipe tree which serves both modules.

Stainless steel receptacle 204 extends from underneath shower floor 192 to a location underneath toilet and lavatory space 194. The receptacle receives water from the shower stall through shower drain plate 206, and receives water from the floor of the toilet and lavatory space through drain plate 208. It also receives water from the lavatory through pipe 210 which extends through a hollow curb separating the shower stall from the toilet and lavatory space. Wastewater is delivered through a trap 212 to a vertically extending sanitary drain pipe 214. The trap serves the bathroom module shown in FIG. 10 as well as a similar module adjacent to it. Both modules are connected to the trap through a connector assembly 216. The trap is built into a pipe tree box 218 which is welded into a rectangular hole in the deck as shown in FIGS. 11 and 12.

As shown in FIG. 12, receptacle 204 has a floor which slopes downwardly toward connector assembly 216. Reducer 220 extends into receptacle 204, and is clamped to one end of the horizontal part of T-connector 222 by clamp 224. A similar reducer 226, which receives water from another bathroom module, is connected to the other end of the horizontal part of T-connector 222 by clamp 228. A vertical leg 230 of the T-connector extends downwardly and is clamped to a short vertical pipe 232 by clamp 234. Pipe 232 is part of the trap, and extends downwardly through horizontal plate 236 to a location near the floor of pipe tree box 218. Panel 236 is welded to the side walls of the pipe tree box as well as to pipe 214. Vertical wall 238 is welded to pipe 214 as well as to one vertical wall of the pipe tree box as shown in FIG. 11. A similar wall (not shown) is located on the opposite side of pipe 214. A baffle 240 extends upwardly from the floor of the pipe tree box to a location well above the opening at the lower end of pipe section 232. An opening 242 is cut in pipe 214 to receive water from the trap.

The advantages of the trap installation as shown in FIGS. 10, 11 and 12 are that a single trap is easier to install and somewhat more readily accessible than the trap shown in FIG. 4.

While the invention has been described in the context of a shipboard bathroom installation, it is of course possible to take advantage of the principles of the invention in such structures as marine drilling platforms and various land-based buildings. The term "deck", therefore, should be understood in its broad sense and as encompassing any of a variety of building floors.

I claim:

1. A plumbing installation comprising a metal deck having an opening, a rigid metal box having vertical side walls, the box being located in the deck opening, and the deck opening substantially conforming to the side walls of the box, said side walls being secured to the deck by a weld whereby the box is supported substantially entirely by the deck, a liquid trap comprising means defining an upright U-shaped flow path having an inlet end and an outlet end, wherein said U-shaped flow path is located at least partly within the box and the lowermost part of said U-shaped flow path is located below the deck surface, first conduit means extending into said box from above the deck, said first conduit means being connected directly to the inlet end of the U-shaped flow path of said trap, and arranged to conduct liquid to said flow path from the exterior of said box, and second conduit means extending into the box from below the deck, said second conduit means being connected directly to the outlet end of said U-shaped flow path and arranged to conduct liquid from said flow path to a location on the exterior of said box below the deck.

2. A plumbing installation according to claim 1 in which the box has a horizontal plate connected to its walls and a plurality of pipes extending vertically through the deck opening, said pipes extending vertically through said horizontal plate and being secured thereto.

3. A plumbing installation according to claim 1 in which the deck includes a deck beam located on its underside, the deck beam having a gap cut in it, said box being located within the gap, and the deck beam element on each side of the gap being welded to a vertical side wall of the box, whereby the box serves as a reinforcing header for the deck beam.

4. A plumbing installation comprising a metal deck having an opening, at least one pipe extending vertically through the opening, a rigid metal box having a horizontal plate and vertical side walls, the box being located in the deck opening and the deck opening substantially conforming to the side walls of the box, said pipe extending vertically through the plate and being secured thereto, and said side walls being secured to the deck by a weld whereby the box is supported substantially entirely by the deck, the deck including a deck beam located on its underside, the deck beam having a gap cut in it, said box being located within the gap, and the deck beam element on each side of the gap being welded to a vertical side wall of the box, whereby the box serves as a reinforcing header for the deck beam.

5. A plumbing installation according to claim 4 having a plurality of pipes extending vertically through the opening, said pipes extending vertically through the plate and being secured thereto.

6. A plumbing installation according to claim 1 in which the box has a bottom plate located below the deck surface, and in which the trap is accessible from above the deck.

* * * * *

UNITED STATES PATENT AND TRADEMARK OFFICE

CERTIFICATE OF CORRECTION

PATENT NO. : 4,622,911

DATED : November 18, 1986

INVENTOR(S) : Arthur H. Salminen

It is certified that error appears in the above-identified patent and that said Letters Patent are hereby corrected as shown below:

At column 8, line 51, before "is" insert the following --assembly serves two bathroom modules and that the trap--

Signed and Sealed this

Seventeenth Day of March, 1987

*Attest:*

DONALD J. QUIGG

*Attesting Officer*

*Commissioner of Patents and Trademarks*